US009192807B2

(12) United States Patent
Spinosa

(10) Patent No.: US 9,192,807 B2
(45) Date of Patent: Nov. 24, 2015

(54) BACKBOARD 3

(71) Applicant: Joseph Spinosa, Honesdale, PA (US)

(72) Inventor: Joseph Spinosa, Honesdale, PA (US)

( * ) Notice: Subject to any disclaimer, the term of this patent is extended or adjusted under 35 U.S.C. 154(b) by 134 days.

(21) Appl. No.: 14/225,785

(22) Filed: Mar. 26, 2014

(65) Prior Publication Data

US 2015/0273265 A1 Oct. 1, 2015

(51) Int. Cl.

| | |
|---|---|
| ***A63B 26/00*** | (2006.01) |
| ***A63B 21/00*** | (2006.01) |
| ***A47C 31/00*** | (2006.01) |
| ***A63B 23/02*** | (2006.01) |
| *A63B 21/16* | (2006.01) |

(52) U.S. Cl.

CPC ..... *A63B 21/1473* (2013.01); *A47C 31/00* (2013.01); *A63B 23/0233* (2013.01); *A63B 2021/1672* (2013.01)

(58) Field of Classification Search

CPC ..... A63B 21/00047; A63B 21/00178; A63B 21/00185; A63B 21/00189; A63B 21/002; A63B 21/0023; A63B 21/078; A63B 21/1457; A63B 21/1461; A63B 21/1473; A63B 21/1496; A63B 2021/0783; A63B 2021/0786; A63B 23/0233; A47C 31/00

See application file for complete search history.

(56) References Cited

U.S. PATENT DOCUMENTS

| | | | | |
|---|---|---|---|---|
| 5,205,804 A * | 4/1993 | Hall | A63B 21/00047 | 482/141 |
| 6,890,289 B2 * | 5/2005 | Spinosa | A63B 23/02 | 482/140 |
| 7,163,497 B2 * | 1/2007 | Spinosa | A63B 23/0233 | 482/140 |

* cited by examiner

*Primary Examiner* — Oren Ginsberg

(57) ABSTRACT

An exercise device for the purpose of strengthening the trunk muscles is used on the top surface of a bed or a similar platform. The exercise device has a rectangular board with a first and second end, a first and second side, a top, and a bottom. A single pair of legs is attached to the first end of the board. A rigid foam covered bar spans the top of said rectangular board and is attached to the first and second sides of the rectangular board.

3 Claims, 3 Drawing Sheets

BACKBOARD 3

BACKGROUND OF THE INVENTION

Acute low back pain is experienced by a large percentage of the U.S. population. According to the NIH, Americans spend at least 50 billion dollars each year to treat low back pain. A sedentary life style and poor muscle strength in the trunk are both major contributing factors to the onset of acute low back pain. In the absence of complex and serious spinal pathology, exercise may be one of the best means of preventing low back pain. The invention is offered as a highly effective means to strengthen the trunk muscles in the home setting at low cost and maximum convenience. The invention provides a means to strengthen both the anterior muscles, Rectus Abdominus, and posterior muscles, Erector Spinae, of the trunk.

BRIEF SUMMARY OF THE INVENTION

The invention consists of a rectangular board that has a pair of legs at one end and a foam covered bar attached at both sides. The board is placed on a bed such that the legs of the board overhang the edge of the bed and the legs are in contact with the floor. The foam covered bar is provided to stabilize the legs and trunk of the user. The board is positioned on the top of the bed and the user lies on the top of the board with her ankles under the foam covered bar. The user will lie prone with the waist at the front edge of the board which overhangs the bed, to perform back extension exercises. The user will lie supine with the ankles retained by the foam covered bar, to perform abdominal strengthening. With the legs folded down on the board, the device may be stored under the bed when not in use.

DESCRIPTION OF THE VIEWS

Figure 1:
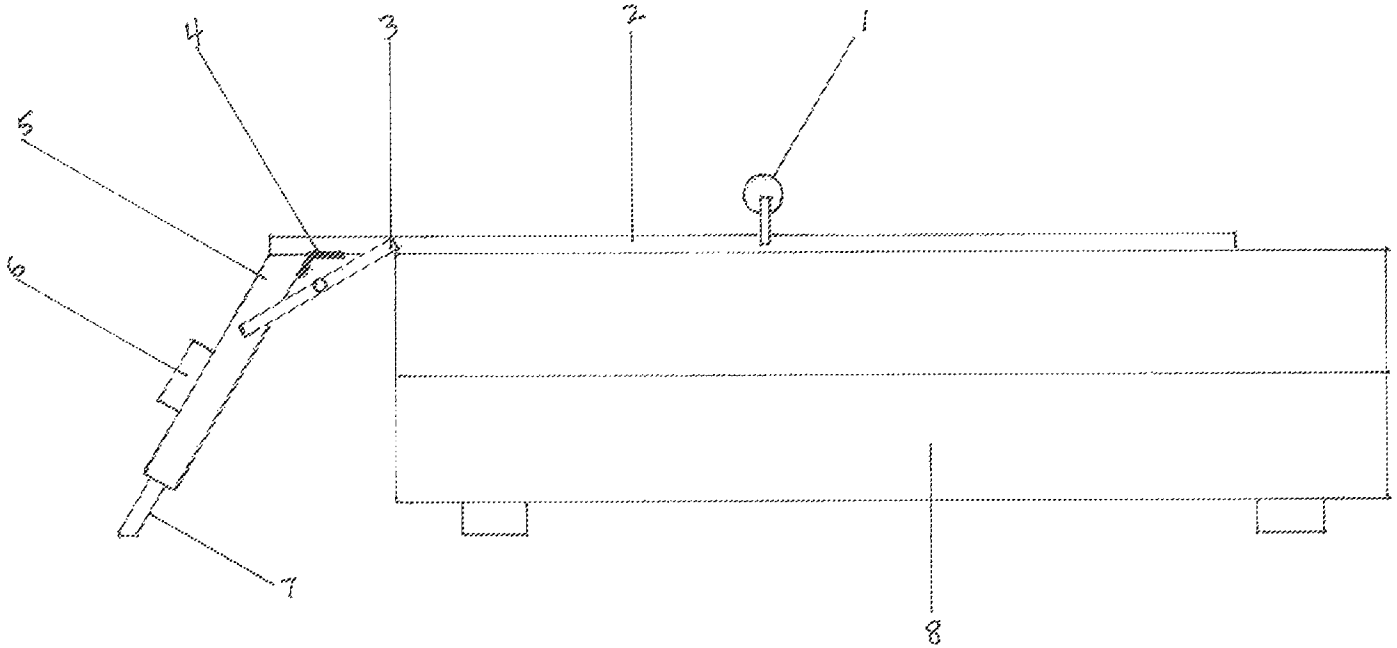
FIG. 1 is a side view of the board as it is positioned on the bed.
Figure 2:
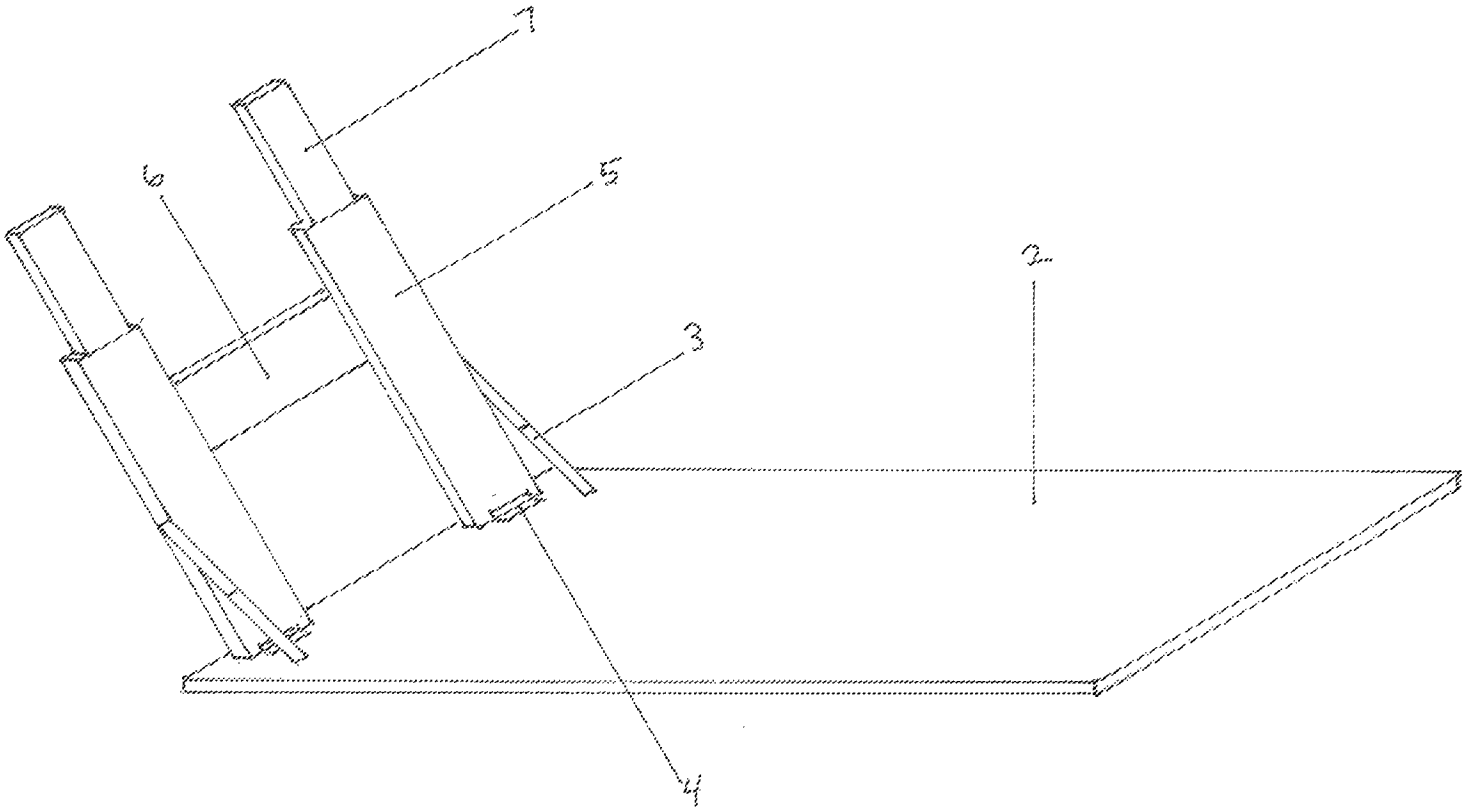
FIG. 2 is a bottom view of the board.
Figure 3:
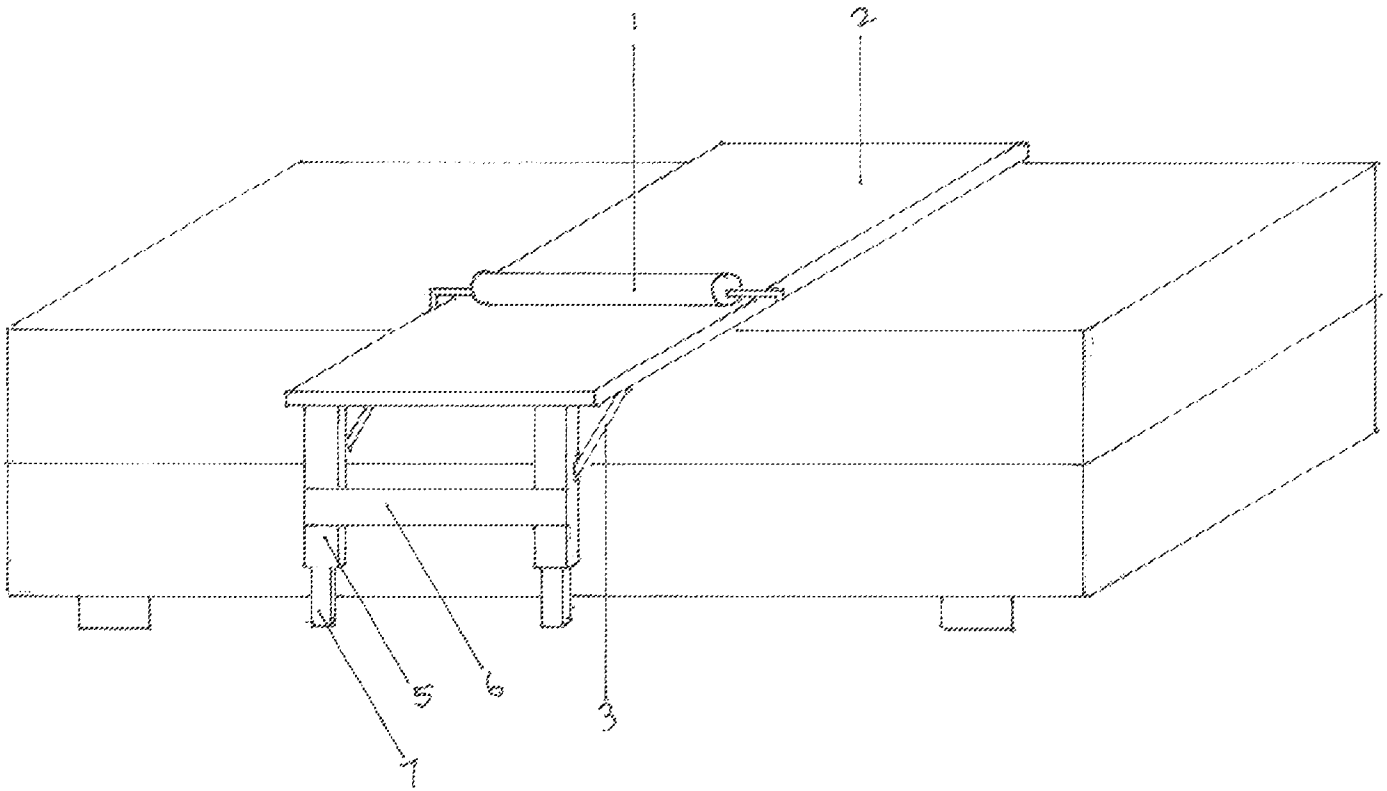
FIG. 3 is a front view of the board as it is positioned on the bed.

The following numbered list corresponds to the parts as detailed and numbered in the three views: 1 Foam covered Bar, 2 Rectangular Board, 3 Locking Table Brace, 4 Hinge, 5 Leg, 6 Cross Brace, 7 Leg-Adjustable portion, 8 Conventional Bed

DETAILED DESCRIPTION

The invention is designed for the purpose of performing trunk strengthening exercises. With the use of this device, trunk extension and trunk flexion are able to be performed on the top surface of a conventional bed. The device consists of a rectangular board which has two legs at one end which can fold down and open up into a locked position. The legs are adjustable in length so that the device will accommodate beds of various heights. When in use, the board is stabilized on the bed by the user's weight and the oblique angle between the legs and the board. When the legs are extended away from the board, they form an angle of 120 degrees with the board. The user's body is stabilized on the board by the foam covered bar under which the user places her ankles. The foam covered bar is attached at the sides of the board and is adjustable both vertically and horizontally on the board. With the legs folded down to the bottom of the board, the device can be stored under the bed.

I claim as my invention:

1. An exercise device for the purpose of strengthening the trunk muscles which is to be used on the top surface of a bed or similar platform, consisting of: a rectangular board with a first and second end, a first and second side, a top, and a bottom, wherein a single pair of legs is attached to said first end of said board and a rigid foam covered bar spans said top of said board and is attached to said first and second sides of said rectangular board.

2. An exercise device according to claim 1, wherein the pair of legs are adjustable in length and joined by a cross brace, are attached to said first end of said rectangular board by means of hinges and locking table braces and can alternately swing down to said bottom of said board and swing away from said board to lock at an angle of 120 degrees away from said board.

3. An exercise device according to claim 1, wherein the rigid foam covered bar overlays said top of said board and is attached at its ends to said first and second sides of said board and is adjustable in position relative to said top of said board in both the vertical and horizontal direction.

* * * * *